United States Patent [19]

White

[11] 4,180,968

[45] Jan. 1, 1980

[54] COMPOSITE YARN AND METHOD OF FORMING SAID YARN

[75] Inventor: Breen C. White, Wollaton, England

[73] Assignee: Courtaulds Limited, London, England

[21] Appl. No.: 845,922

[22] Filed: Oct. 27, 1977

[30] Foreign Application Priority Data

Sep. 19, 1977 [GB] United Kingdom ..... 38921/77

[51] Int. Cl.[2] ..... D02G 3/04

[52] U.S. Cl. ..... 57/239; 57/247; 57/284

[58] Field of Search ..... 57/140 BY, 157 TS, 6, 57/227, 228, 238, 239, 243, 244, 245, 246, 247, 284, 332, 351

[56] References Cited

U.S. PATENT DOCUMENTS

| | | | |
|---|---|---|---|
| 2,199,428 | 5/1940 | Finlayson et al. | 57/351 |
| 2,904,953 | 9/1959 | Groombridge et al. . | |
| 3,162,995 | 12/1964 | Comer et al. | 57/157 TS |
| 3,430,314 | 3/1969 | Sayers . | |
| 3,523,416 | 8/1970 | Wolf | 57/157 TS X |
| 3,526,084 | 9/1970 | London et al. | 57/239 |
| 3,768,245 | 10/1973 | Braker | 57/140 BY |
| 3,936,996 | 2/1976 | Schiffer | 57/140 BY |

*Primary Examiner*—Donald Watkins

*Attorney, Agent, or Firm*—Davis, Hoxie, Faithfull & Hapgood

[57] ABSTRACT

A composite filament yarn made by plying untexturized cellulose acetate yarn with polyamide or polyester yarn is made more coherent by false-twist texturizing it. The increased coherence prevents bunching of the acetate yarn during knitting and so the associated shade variation is avoided. The acetate yarn is spun-dyed and the polyamide or polyester yarn is package-dyed after pretexturizing. The acetate and synthetic yarns may be dyed to matching shades.

9 Claims, 5 Drawing Figures

COMPOSITE YARN AND METHOD OF FORMING SAID YARN

Figure 1:
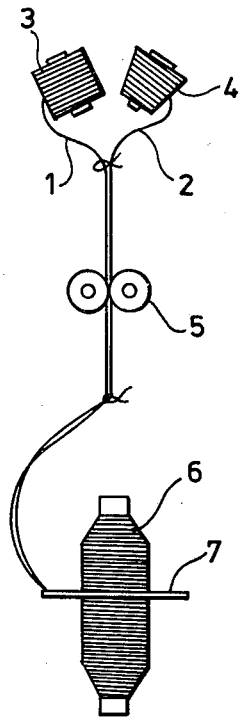

This invention relates to a process for making a composite yarn incorporating cellulose acetate filaments and to a yarn so made.

Filament yarn of cellulose acetate, which term includes cellulose diacetate and cellulose triacetate, is valued for its good aesthetic properties in particular its hand and drape in fabric form. However, although it compares favourably with synthetic yarns in these respects, it is comparatively weak and does not have the easy-care properties of the synthetic yarns.

One way of overcoming these deficiencies has been to combine the cellulose acetate yarn with a support yarn of synthetic filaments such as polyester or polyamide filaments to form a composite yarn combining strength and easy-care properties with good aesthetics. Such a yarn is described in U.S. Pat. No. 2,904,953, in particular a yarn which is made by doubling a texturised cellulose acetate yarn, which is optionally spun-dyed, with a pre-formed support yarn of polyamide or polyester filaments. U.S. Pat. No. 3,523,416 describes the same process of doubling a spun-dyed texturised cellulose acetate yarn with a package-dyed texturised polyester yarn.

One problem which arises when the component yarns are simply doubled is shade variation both along the composite yarn length and between different composite yarn ends. The main reason for this is variation in the proportions of the component yarns caused by bunching of one component yarn, usually the cellulose acetate yarn, at irregular intervals along the composite yarn. Bunching is particularly liable to occur during knitting of the yarn into fabric, being caused by the action of the knitting needles and the associated yarn guides. One way of alleviating this is by interlacing the component yarns prior to doubling as described in British Pat. No. 1,117,502, but interlacing is subject to its own variation in degree and moreover adds the cost of an extra step to the process.

The present invention provides a process for making a coherent composite yarn comprising providing at least one component yarn of untexturised cellulose acetate filaments and at least one other component yarn of polyester of polyamide filaments, twisting said component yarns together to form a composite yarn, and false-twist texturising said composite yarn.

The false-twist texturising of the composite yarn makes the component yarns cohere and so provides a resistance against the bunching of one component yarn. This promotes an even colour effect in fabric made from the composite yarn.

The temperature up to which the yarn is heated whilst it is false-twisted during the texturising is preferably from 170° to 185° C. Above this range the cellulose acetate component yarn can become adversely affected, and below this range the texturising effect may be inadequate.

The polyester or polyamide component yarn may be flat yarn, i.e. untexturised, or it may be texturised yarn. With polyester component yarn, the range of temperature preferred in the present process for texturising the composite yarn, 170° to 185° C., is a little lower than is used in the commercial texturising of standard polyester yarn so that pre-texturising is desirable to give optimum texture in the polyester component. If the yarn has been package-dyed it will usually have been pretexturised anyway to facilitate the package dyeing operation.

The component yarns may be dyed to matching shades of colour to provide a composite yarn of uniform colour or one component yarn may be left undyed or dyed to a different shade or colour from the other component yarn to give marl, heather, or tone-on-tone effects in the composite yarn. Whilst it is possible to dye the fabric or garment made from the composite yarn, particularly when the cellulose acetate component is the triacetate, the preferred route is the dyeing of the component yarns individually prior to combination.

The individual yarn dyeings may be carried out by any of the conventional techniques, but the preferred methods are spin-dyeing for cellulose diacetate component yarn and package-dyeing for polyester or polyamide component yarn. Cellulose triacetate component yarn may be spun-dyed or package-dyed.

The twisting together of the component yarns may be carried out on a commercial downtwisting frame or on a doubling frame. The resulting composite yarn may be false-twist texturised on commercial machines using false-twist units of either the spinner peg type (Scragg Superset, Barmag and A.R.C.T. machines) or the friction type, including intermeshing stacks of friction discs (Scragg Positorque, Barmag and FAG units) and friction bushes (Sotexa). Set yarn may be produced by giving the false-twist texturised yarn a heat relaxation treatment in which case double-heater texturising machines may be used. Alternatively, or additionally, the yarn may be steamed on package.

The invention includes a coherent composite yarn made by the process of the invention, and in particular, such a composite yarn comprising spun-dyed cellulose acetate filaments and package-dyed polyester or polyamide filaments, preferably dyed to matching shades of colour. The number of ends of each yarn component may be varied to give a range of composite yarns of varying properties.

Figure 2:
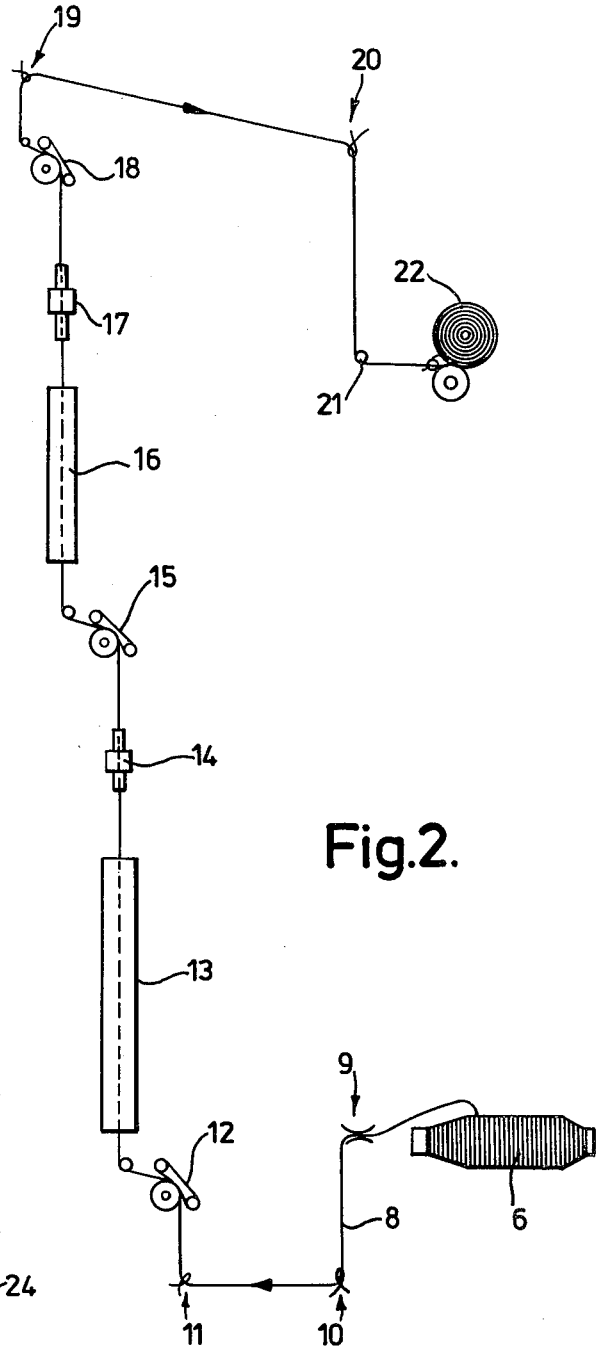
Figure 3:
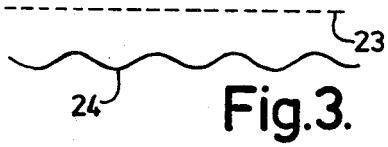
Figure 4:
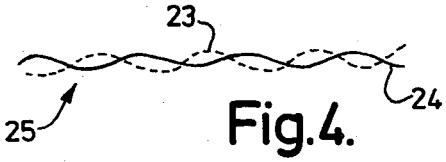
Figure 5:
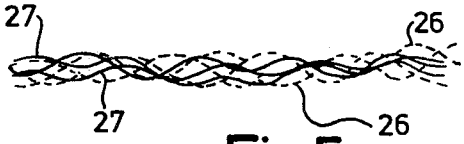

The invention is illustrated, by way of example, by the accompanying drawing, in which:

FIG. 1 is a schematic diagram of a downtwisting operation,

FIG. 2 is a schematic diagram of an A.R.C.T. double-spindle, double-heater, false-twist texturising machine, FIG. 3 is a schematic representation of the component yarns comprising untexturised cellulose acetate yarns and texturised polyester or polyamide yarn, FIG. 4 is a schematic representation of the component yarns shown in FIG. 3 after being twisted together to form a composite yarn, and FIG. 5 is a schematic representation of the composite yarn after it has been false-twist texturised and showing the interengagement of just a few of the filaments of each component yarn.

Referring to FIG. 1, a spun-dyed, untexturised cellulose acetate yarn 1 and a package-dyed texturised polyester or polyamide yarn 2 are withdrawn from cheese 3 and cone 4 respectively by nip rollers 5 and twisted together to form a cop 6 of composite yarn on ring spindle 7. The polyester or polyamide yarn is preferably coned from the dye-spring after package-dyeing.

The cop 6 is then transferred to the A.R.C.T. texturising machine depicted in FIG. 2. The composite yarn 8 is drawn off the cop 6, via tensioner 9 and guides 10 and 11, by a first yarn feed 12. It is fed upwards through a first heater 13 of the curved tube-type and a first false-twist spindle 14 by a second yarn feed 15. The false-twisted yarn is then fed successively through a second tube-type heater 16 and a second false-twist spindle 17, which is rotated in the reverse sense to the first spindle, by a third yarn feed 18. This feeds the yarn via guides 19, 20 and 21 to the surface-driven take-up package 22. All the yarn feeds shown are of the Casablanca apron type.

The A.R.C.T. machine described can of course be used as a conventional single-spindle double-heater machine by taking out or bypassing the second spindle.

In FIG. 3 the straight chain line depicts an untexturised cellulose acetate component yarn 23 and the full, wavy line depicts a texturised polyester or polyamide component yarn 24. These are shown twisted together to form a composite yarn 25 in FIG. 4. In FIG. 5 the chain line and full line conventions are used to represent the individual filaments of the respective yarn components, and just a few of these filaments, 26 and 27 respectively, are shown in a representation of their interengagement within the composite yarn 25 after it has been false-twist texturised.

The invention is further illustrated by the following Examples:

EXAMPLE 1

Two ends of untexturised, spun-dyed cellulose diacetate yarns, each of count 220 dTex and comprising 32 filaments, and one end of false-twist texturised, package-dyed polyester yarn (polyethylene terephthalate) of count 167 dTex and comprising 32 filaments, were twisted together on a downtwister which inserted 80 turns per meter (t.p.m.) folding twist. The cellulose diacetate yarns had been spun-dyed a carmine colour and the polyester yarn had been package-dyed to a matching shade of carmine.

The 607/96 composite yarn so formed was then false-twist texturised on a double-spindle A.R.C.T. machine as illustrated schematically in FIG. 2 of the drawing using the following machine conditions:

| | |
|---|---|
| First heater (13) temperature | 175° C. |
| Inserted twist - first spindle (14) | 1285 t.p.m. |
| Twist direction - first spindle (14) | 'S' |
| Overfeed between first (12) and second (13) feeds | −7 percent |
| Second heater (16) temperature | 200° C. |
| Inserted twist - second spindle (17) | 999 t.p.m. |
| Twist direction - second spindle (17) | 'Z' |
| Overfeed between second (15) and third (18) feeds | 0 percent |
| Overfeed onto take-up package (22) | +6 percent |

The texturised composite yarn was knitted into fabric which had a uniform carmine colour. On examination the component yarns were still coherent and there was no apparent bunching of the cellulose diacetate yarns.

EXAMPLE 2

The procedure of Example 1 was repeated with the difference that only a single end of untexturised 220/32 cellulose diacetate was used to give a 387/64 composite yarn, and the second spindle (17) on the A.R.C.T. machine was not used. The other texturising machine conditions were as follows:

| | |
|---|---|
| First heater (13) temperature | 175° C. |
| Inserted twist - spindle (14) | 1285 t.p.m. |
| Twist direction - spindle (14) | 'Z' |
| Overfeed between first (12) and second (15) feeds | −7 percent |
| Second heater (16) temperature | 180° C. |
| Overfeed between second (15) and third (18) feeds | +16 percent |
| Overfeed onto take-up package (22) | −4 percent |

The texturised composite yarn was knitted into fabric which had a uniform colour. On examination the component yarns were still coherent and there was no apparent bunching of the cellulose diacetate yarn.

EXAMPLE 3

The procedure of Example 2 was repeated with the difference that the single end of cellulose diacetate yarn was replaced by a single end of 220/32 cellulose triacetate yarn. The cellulose triacetate had been spun-dyed a turquoise colour and the polyester had been package dyed to a matching shade of turquoise.

The same conditions were used on the A.R.C.T. texturising machine as were used in Example 2 despite the change to cellulose triacetate yarn.

The texturised composite yarn was knitted into fabric which had a uniform turquoise colour. On examination the component yarns were still coherent and there was no apparent bunching of the cellulose triacetate yarn.

What is claimed is:

1. A process for making a coherent composite yarn comprising providing at least one component yarn of untexturised cellulose acetate filaments and at least one other component yarn of polyester or polyamide filaments, twisting said component yarns together to form a composite yarn, and false-twist texturising said composite yarn.

2. A process as claimed in claim 1 including the preliminary steps of texturising then package-dyeing the component yarn of polyamide or polyester filaments.

3. A process as claimed in claim 2 including the preliminary step of spin-dyeing the cellulose acetate component yarn.

4. A process as claimed in claim 3 in which the cellulose acetate component yarn and the component yarn of polyester or polyamide filaments are so dyed to matching shades of colour.

5. A process as claimed in claim 1 in which the composite yarn is heated up to a temperature of from 170° to 185° C. whilst in the false-twisted state during texturising.

6. A process as claimed in claim 1 including the additional step of heating the texturised composite yarn whilst allowing it to relax.

7. A coherent composite yarn made by a process as claimed in claim 1.

8. A coherent composite yarn made by a process as claimed in claim 3.

9. A coherent composite yarn made by a process as claimed in claim 4.

* * * * *